US008479400B2

(12) United States Patent
Fukutani et al.

(10) Patent No.: US 8,479,400 B2
(45) Date of Patent: Jul. 9, 2013

(54) HAIR CLIPPER

(75) Inventors: Makoto Fukutani, Hikone (JP); Toshio Ikuta, Hikone (JP)

(73) Assignee: Panasonic Corporation, Osaka (JP)

( * ) Notice: Subject to any disclaimer, the term of this patent is extended or adjusted under 35 U.S.C. 154(b) by 131 days.

(21) Appl. No.: 11/892,833

(22) Filed: Aug. 28, 2007

(65) Prior Publication Data

US 2008/0052915 A1 Mar. 6, 2008

(30) Foreign Application Priority Data

Aug. 31, 2006 (JP) ..... 2006-236539

(51) Int. Cl.
*B26B 19/06* (2006.01)
*B26D 19/20* (2006.01)

(52) U.S. Cl.
USPC ..... 30/195; 30/208; 30/346.61; 30/355

(58) Field of Classification Search
USPC ..... 30/346.61, 351, 355, 195, 200, 201, 30/202, 205, 208–210
See application file for complete search history.

(56) References Cited

U.S. PATENT DOCUMENTS

| | | | | |
|---|---|---|---|---|
| 1,458,326 | A * | 6/1923 | Connor | 30/225 |
| 2,256,076 | A * | 9/1941 | Coles | 30/34.05 |
| 4,152,830 | A * | 5/1979 | Meijer et al. | 30/195 |
| 4,782,592 | A * | 11/1988 | Altamore | 30/195 |
| 5,600,890 | A * | 2/1997 | Leitner et al. | 30/223 |
| 7,841,091 | B2 * | 11/2010 | Melton | 30/223 |
| 2004/0016128 | A1 * | 1/2004 | Yanosaka et al. | 30/225 |
| 2007/0214654 | A1 * | 9/2007 | Chen et al. | 30/210 |

FOREIGN PATENT DOCUMENTS

| | | |
|---|---|---|
| CN | 1451513 | 10/2003 |
| DE | 649 465 | 8/1937 |
| DE | 20 2006 002532 | 4/2006 |
| FR | 2 411 677 | 7/1979 |
| GB | 265 347 | 2/1927 |
| JP | 64-049596 | * 2/1989 |
| JP | 2000-308768 | 7/2000 |
| JP | 2000-308768 | * 11/2000 |

* cited by examiner

*Primary Examiner* — Laura M. Lee
(74) *Attorney, Agent, or Firm* — Bacon & Thomas, PLLC

(57) ABSTRACT

A hair clipper includes a comb-like fixed blade and movable blade having a plurality of blade pieces arranged in parallel. The fixed blade and the movable blade is overlapped with each other and the movable blade is reciprocatively slid with respect to the fixed blade in an arrangement direction of the blade pieces. Each blade piece of the movable blade has blade edges formed at both sides thereof, each blade edge being formed with a leading rectilinear part and a basal rectilinear part; the leading rectilinear part and the basal rectilinear part are inclined with respect to the blade edges formed at both sides of each blade piece of the fixed blade by an acute included angle α; and each blade edge of the movable blade has a rake surface facing an opposite side to the fixed blade.

5 Claims, 10 Drawing Sheets

(PRIOR ART)

HAIR CLIPPER

FIELD OF THE INVENTION

The present invention relates to a hair clipper for cutting hair by reciprocating a movable blade with respect to a fixed blade.

BACKGROUND OF THE INVENTION

Conventionally, there is a known hair clipper including comb-like fixed blade and movable blade having a plurality of blade pieces arranged in parallel. This hair clipper is used for cutting hair by reciprocating the movable blade with respect to the fixed blade in the arrangement direction of the blade pieces.

Conventionally, the blade pieces 30 of the movable blade 3 each have a tapered end portion as shown FIG. 9. However, while sliding the movable blade 3 with respect to the fixed blade, hair 40 introduced into a blade groove 32 between the adjacent blade pieces 30 comes out of the blade groove 32 as indicated by an arrow in the FIG. 9. As a result, the hair 40 cannot be cut efficiently.

Further, for example, Japanese Patent Laid-open Application No. 2000-308768 discloses a circular-shaped blade groove formed between adjacent blade pieces of each of fixed blade and a movable blade. The width of the blade groove formed between the blade pieces is getting shorter inwardly and outwardly from the center thereof. Accordingly, the hair can be prevented from coming out from the blade groove by guiding the hair introduced in the blade groove to the center portion of the blade groove. In the Japanese Patent Application, however, the blade edges of the blade pieces have an arc shape, so that the included angle between the blade edge of the movable blade and the blade edge of the fixed blade is varied in a projecting direction of the blade pieces when cutting the hair. As a result, it is difficult to get an effective acute angle for cutting the hair.

Further, the Japanese Patent Application also discloses, as a modified example, side edges of the blade pieces formed in a "<" or ">" shape. However, there is no disclosure about the blade edges or a rake angle of the blade pieces.

SUMMARY OF THE INVENTION

The present invention provides a hair clipper capable of cutting hair efficiently along the entire projecting direction of the blade piece of the movable blade by guiding the hair introduced into the blade groove to the center portion of the blade groove and preventing the hair from escaping from the blade groove, and preventing hair pulling.

In accordance with an embodiment of the present invention, there is provided a hair clipper including a comb-like fixed blade and movable blade having a plurality of blade pieces arranged in parallel, the fixed blade and the movable blade being overlapped with each other, and the movable blade being reciprocatively slid with respect to the fixed blade in an arrangement direction of the blade pieces. Each blade piece of the movable blade has blade edges formed at both sides thereof, each blade edge being formed with a leading rectilinear part inclined such that the distance between the adjacent blade pieces is getting greater as it goes from the leading end of the blade piece toward the basal end of the blade piece, and with a basal rectilinear part having one end connected the leading rectilinear part and inclined such that the distance between the adjacent blade pieces is getting greater as it goes from the connected end to the basal end of the blade piece. The leading rectilinear part and the basal rectilinear part of each blade edge of the movable blade are inclined with respect to the blade edges formed at both sides of each blade piece of the fixed blade by an acute included angle $\alpha$. Further, each blade edge of the movable blade has a rake surface facing an opposite side to the fixed blade, the rake surface being inclined with respect to the sliding direction of the movable blade throughout an entire length of the leading rectilinear part and the basal rectilinear part by an acute rake angle.

Since the blade edges of the blade piece are formed in a "<" or ">" shape so that the hair introduced into each blade groove formed between the adjacent blade pieces, when cutting the hair, can be guided to the center portion of the blade groove having a larger groove width. Further, the blade edges of the movable blade, i.e., both the leading rectilinear part and basal rectilinear part of the blade pieces are inclined to the blade edges of the fixed blade through out the entire length thereof by the acute included angle $\alpha$ so that the hair can be cut effectively along the entire projecting direction Y of the blade pieces of the movable blade. Furthermore, the blade edges of the movable blade have the rake surface by an acute angle $\beta$ throughout the entire length of the leading rectilinear part and the basal rectilinear part. Therefore, it is possible to prevent the hair from being pulled by the blade edges of the movable blade throughout the entire projecting direction Y of the blade pieces of the movable blade.

Further, it is preferable that the included angle $\alpha$ is in a range of $0<\alpha<40$.

In accordance with the present invention, the hair clipper can prevent the hair from coming out of the blade groove by guiding the hair introduced into the blade groove to the center portion of the blade groove, cut the hair efficiently in an entire projecting direction of the blade pieces of the movable blade, and prevent the hair pulling.

BRIEF DESCRIPTION OF THE DRAWINGS

The above and other objects and features of the present invention will become apparent from the following description of embodiments given in conjunction with the accompanying drawings, in which:

FIG. 2 shows the entire hair clipper, wherein

FIG. 10 shows a blade edge without having a rake surface.

DETAILED DESCRIPTION OF THE EMBODIMENTS

Figure 2A:
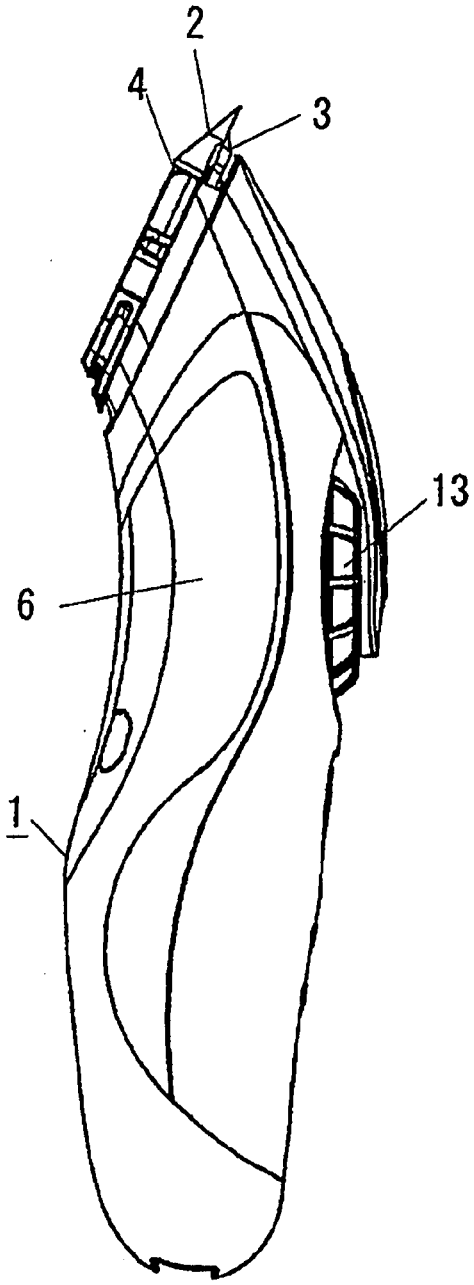
FIG. 2A is a side view and FIG. 2B is a front view.
Figure 2B:
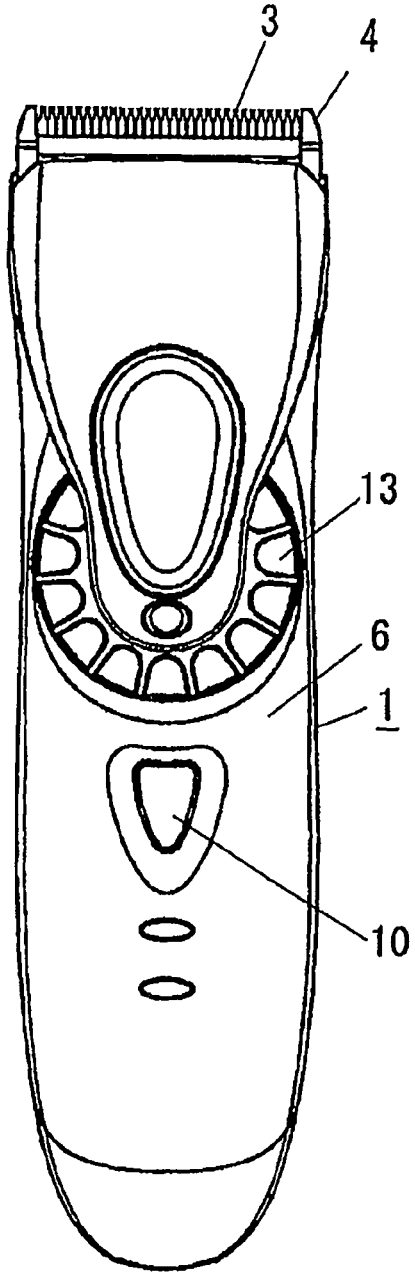

Hereinafter, embodiments of the present invention will be disclosed with reference to the accompanying drawings. A hair clipper in accordance with an embodiment of the present invention has an elongated main body 1, which also functions as a grip, as shown in FIGS. 2A and 2B. A blade block 4 having a fixed blade 2 and a movable blade 3 is mounted on a leading end of the main body 1 in its longitudinal direction (top end in FIGS. 2A and 2B). The movable blade 3 of the blade block 4 is slidingly reciprocated in the lateral direction (left-right direction in FIG. 2B) with respect to the fixed blade 2 by a motor disposed in the main body 1 as a driving source, so that hair 40 introduced into blade grooves 22 on the tip of the fixed blade 2 is sandwiched between the fixed blade 2 and the movable blade 3 and cut thereby.

Figure 3:
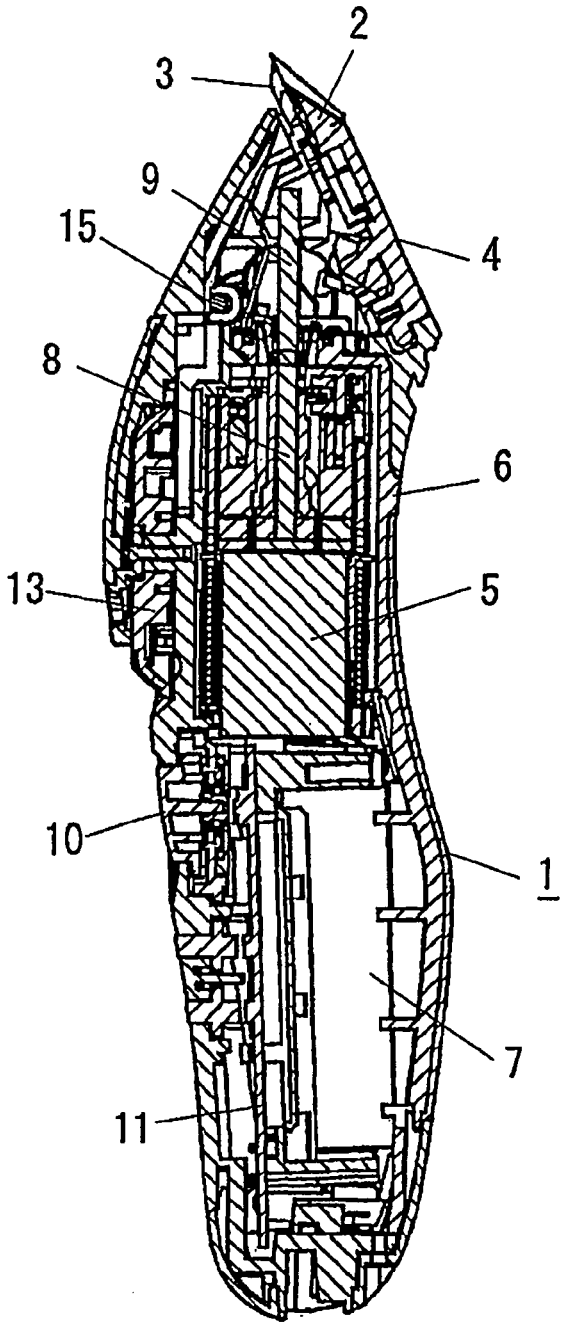
FIG. 3 is a cross-sectional view in accordance with the embodiment of the present invention.

Referring to FIG. 3, the main body 1 has a housing 6 having a substantially S-shaped appearance as viewed from side. A user can grasp the housing 6 with his or her one hand. Accommodated in the housing 6 are a rechargeable battery 7, a motor 5 to which electricity is supplied from the rechargeable battery 7, the motor 5 generating a reciprocal driving force, a power transmitting mechanism 8 for transmitting the reciprocal driving force of the motor 5 toward the top side in the drawing, an output shaft 9 reciprocatively driven by the power transmitting mechanism 8, and a controller 11 for controlling the supply of electricity to the motor 5 in accordance with pushing operation of an operating switch 10 which is exposed outside.

The output shaft 9 projects upward in the drawing from the housing 6 to be connected to a guide plate 17, which will be described later, provided on the blade block 4. A dial 13 for adjusting the cutting height is rotatably disposed above (in the drawing) the operating switch 10 on an outer surface of the housing 6. A transmitting mechanism 15 is provided in the main body housing 6, the transmitting mechanism 15 raising or tilting a later-described switch lever 19 of the blade block 4 in association with normal or reverse rotation of the dial 13.

Figure 4:
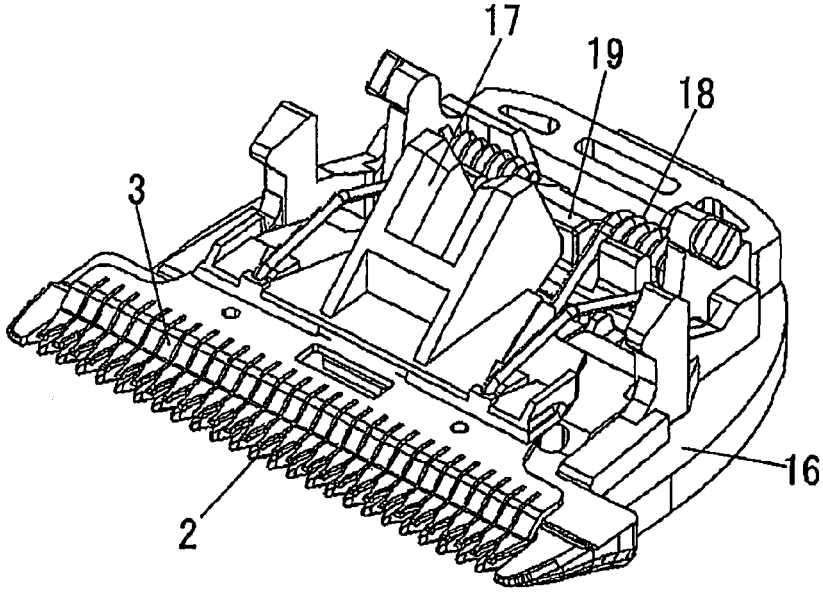
FIG. 4 is a perspective view of the entire blade block in accordance with the embodiment of the present invention.
Figure 5:
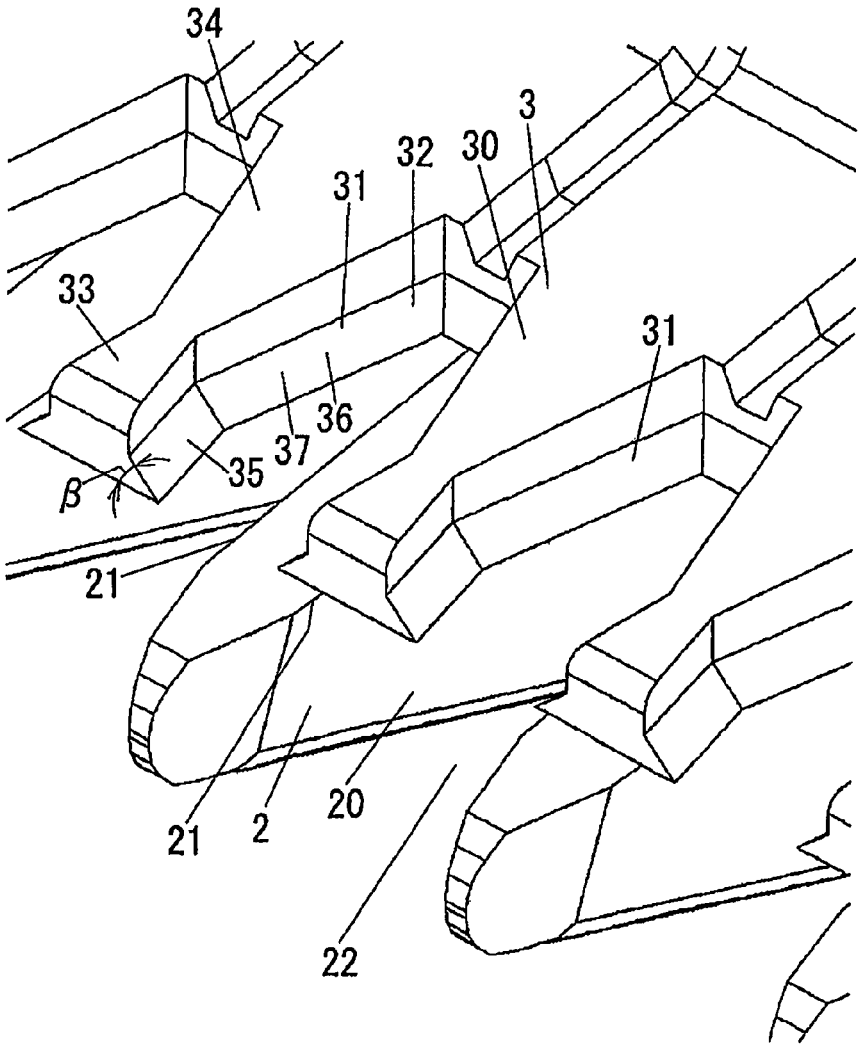
FIG. 5 is an enlarged perspective view of the main part of the blade block in accordance with the embodiment of the present invention.
Figure 6:
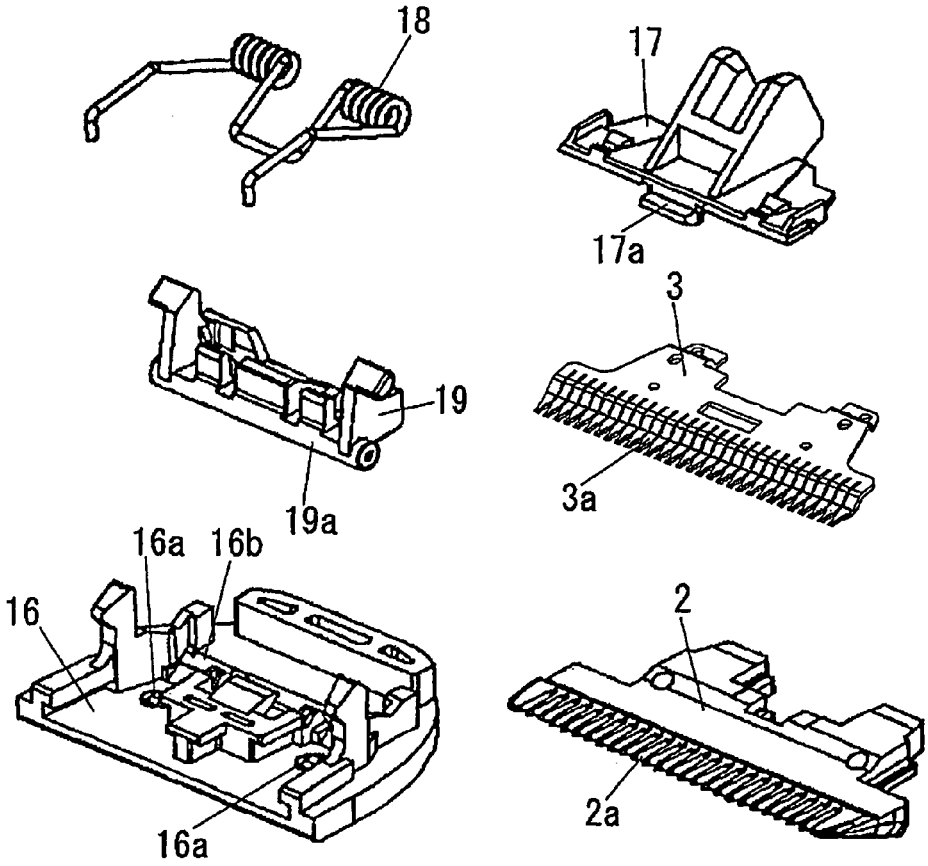
FIG. 6 is an exploded perspective view of the main part of the blade block in accordance with the embodiment of the present invention.

FIG. 4 is a perspective view of the entire blade block 4; FIG. 5 is an enlarged perspective view of the main part of the FIG. 4; and FIG. 6 is an exploded perspective view of the blade block 4. The blade block 4 includes the comb-like fixed blade 2 having a plurality of tapered blade pieces 20 arranged in parallel, each being provided at its both sides with blade edges 21; the comb-like movable blade 3 having a plurality of tapered blade pieces 30 arranged in parallel, each being provided at its both sides with blade edges 31; and a fixing plate 16 having a hook 16*a* to be engaged with the fixed blade 2, the fixed blade 2 being fixed by the hook 16*a*. The blade block 4 further includes a guide plate 17 having a hook 17*a* to be engaged with the movable blade 3, the movable blade 3 being fixed by the hook 17*a* and a heat seal; a coil-shaped push-up spring 18 disposed between the fixing plate 16 and the guide plate 17 in a resiliently deformed state which gives a biasing force for pushing the movable blade 3 against the fixed blade 2; and a switch lever 19 which has a columnar portion 19*a* pivotably supported by a semi-circular groove 16*b* formed in the fixing plate 16. The switch lever 19 is disposed on the fixing plate 16 so that it can be raised and tilted around the columnar portion 19*a*, and is biased to be tilted by the push-up spring 18 by the coil portion of the push-up spring 18 engaged therewith. If the switch lever 19 is turned to be raised against the biasing force of the push-up spring 18, the movable blade 3 slides in the projecting direction Y (shown FIG. 1) of blade pieces 20 and 30 while being pressed against the fixed blade 2 via the push-up spring 18 and the guide plate 17.

The raising and tilting operation of the switch lever 19 is carried out through the transmitting mechanism. That is, if the dial 13 is rotated in a normal direction, the switch lever 19 is turned to be raised through the transmitting mechanism 15 against the biasing force of the push-up spring 18. As a result, the movable blade 3 slides such that the leading ends of the blade pieces 30 approach those of the blade piece 20 of the fixed blade 2. If the dial 13 is rotated in a reverse direction, the switch lever 19 turns to be tilted by the biasing force of the push-up spring 18, and the movable blade 3 slides such that the leading ends of the blade pieces 30 are separated away from those of the blade piece 20 of the fixed blade 2. Each blade piece 20 of the fixed blade 2 is tapered as viewed from side such that its thickness is varied along the projecting direction Y. Therefore, by changing the slide position of the movable blade 3 with respect to the fixed blade 2, the cutting height of the hair 40 can be adjusted.

Figure 1:
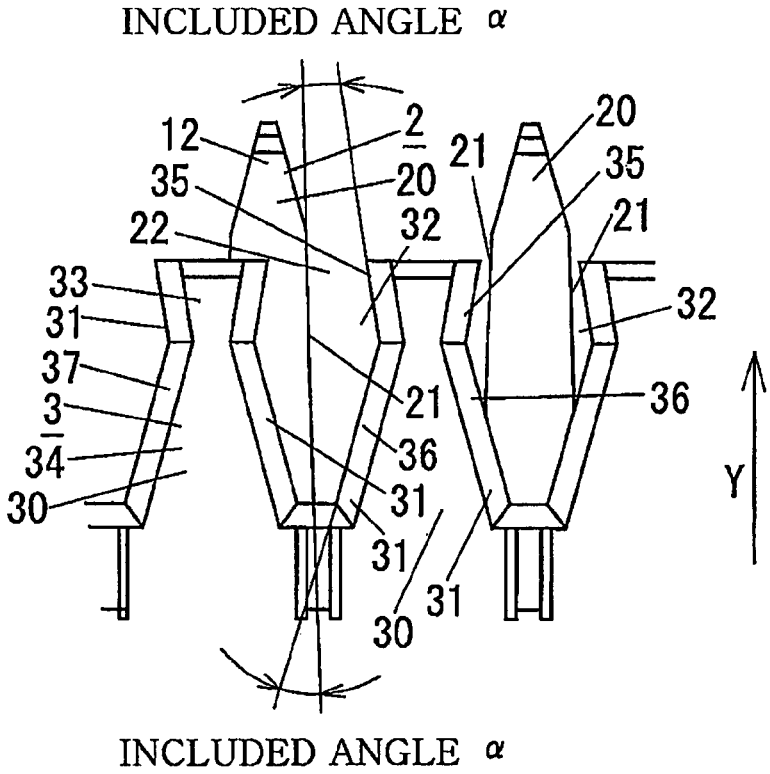
FIG. 1 is an enlarged front view of the main part of a blade block in accordance with an embodiment of the present invention.

As shown FIGS. 1 and 5, the leading portions of the blade pieces 20 of the fixed blade 2 are protruded beyond the blade pieces 30. Basal portions of the blade pieces 20 each have at both sides linear blade edges 21 substantially parallel with the projecting direction Y. The blade edges 21 as shown in the drawings are slightly inclined to the projecting direction Y in such a way that the width of the blade grooves 22 formed between the adjacent blade pieces 20 becomes narrower as it goes to the basal end. Further, both sides of the leading portion of the each blade piece 20 of the fixed blade 2 are inclined to the projecting direction Y at a greater angle than that of the blade edges 21 in such a way that the distance between the adjacent blade pieces 20 becomes greater as it goes to the leading end. The leading portions function as a guide part 12 so as to introduce the hair 40 into the blade grooves 22 effectively.

Meanwhile, each blade piece 30 of the movable blade overlapped with the fixed blade 2 protrudes in a substantially same direction as the blade piece 20 of the fixed blade 2. The blade edges 31 provided at both sides of each of the blade piece 30 is formed along the projecting direction Y of each blade piece 30. Each blade piece 30 of the movable blades 3 includes an isosceles trapezoid-shaped leading part 33, as viewed from front, which becomes wider as it goes to the leading end, and an isosceles trapezoid-shaped basal part 34, as viewed from front, which becomes wider as it goes to the basal end. Accordingly, the blade edges 31 formed at both sides of each blade piece 30 at the fixed blade 2 side includes blade edges formed at both sides of the leading part 33 and both sides of the basal part 34. Blade edges formed at both sides of the leading part, i.e., leading rectilinear parts 35 are inclined in such a way that the distance between the adjacent blade pieces 30 (width of the blade groove 32) becomes greater as it goes from the leading end of the blade piece 30 to the basal end thereof. Blade edges formed at both sides of the basal part 34, i.e., basal rectilinear parts 36 are connected to a basal end of the rectilinear part 35 and inclined in such a way that the distance between the adjacent blade pieces 30 becomes smaller as it goes from the connected point to the basal end of the blade piece 30.

The overall shape of the leading rectilinear part 35 and the basal rectilinear part 36 of each blade edge 31 is "<" or ">" as viewed from front. The curved portion of the "<" or ">" shape in the blade edge 31 may be provided with a third surface, i.e., an inclined surface having a different angle from the leading rectilinear part 35 and the basal rectilinear part 36, or a surface parallel with the projecting direction Y.

Figure 7:
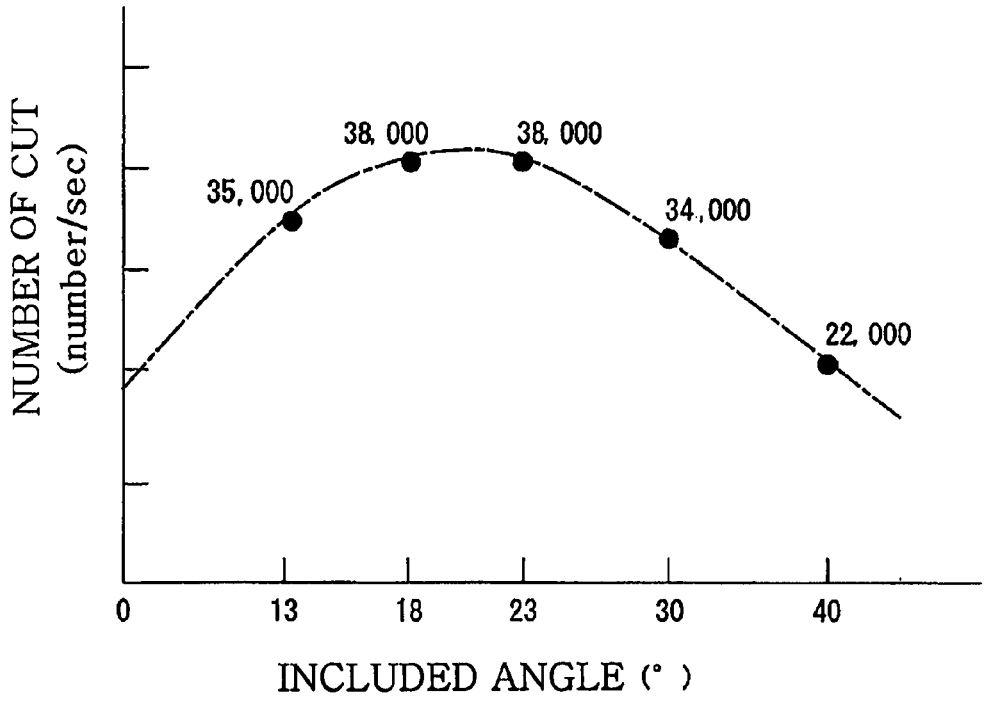
FIG. 7 is a graph showing the relation between an included angle and a number of cut hair.
Figure 8:
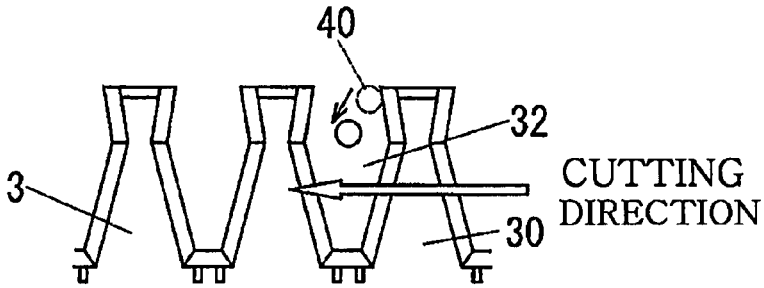
FIG. 8 is a front view showing a state that the hair is introduced to the center portion of a blade groove by a blade part of a movable blade.
Figure 9:
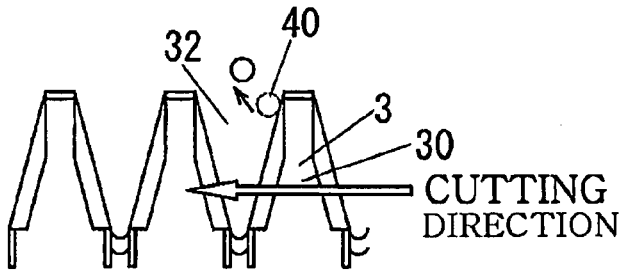
FIG. 9 is a front view showing a state that the hair is coming out of the blade groove by the blade part of the movable blade in a conventional hair clipper.

The leading rectilinear parts 35 and the basal rectilinear parts 36 of the blade edges 31 of both sides of each blade piece 30 are inclined with respect to the linear shape blade edges 21 of the fixed blade 2, which is interposed between the blade pieces 30 and performs a cutting action, thereby forming an acute included angle $\alpha$ therebetween. The included angle $\alpha$ is the angle between the blade edge 21 of the fixed blade 2 and the blade edge 31 of the movable blade 3. The angle $\alpha$ is set in a range of $0° < \alpha < 40°$ both for the leading rectilinear part 35 and the basal rectilinear part 36. Further, the range of the included angle $\alpha$ is an optimum range which is experimentally derived from the relation between the included angle $\alpha$ and the number of the cut hair 40 as shown FIG. 7. As shown FIG. 7, the preferred angular range corresponding to at least 80% of the maximum number of cut is 11° to 30°, more preferable angular range which can achieve the maximum number of cut is 16° to 23°.

Further, each blade edge 31 of the movable blade 3 is provided with a rake surface 37 facing an opposite side to the fixed blade 2 (noncontact surface) inclined with respect to the sliding direction of the movable blade 3 by a acute rake angle $\beta$, extending across the leading rectilinear part 35 and the basal rectilinear part 36. The rake surface 37 is made to be closer to the fixed blade 2 as it goes to the leading end of the blade edge 31. Both side surfaces of the blade edge 31 of each blade piece 30 of the movable blade 3 are substantially perpendicular to the sliding surface thereof with respect to the fixed blade 2. The cross-sectional shape of the blade piece 30 has a trapezoidal portion at the half thereof on the side of the fixed blade 2 (lower portion) and a rectangular portion at the other half thereof on the other side (upper portion).

In the hair clipper as disclosed above, the blade edges 31 of the blade piece 30 are formed in the "<" or ">" shape so that the hair 40 introduced into each blade groove 32 of the movable blade 3, when cutting the hair, can be guided to the center portion of the blade groove 32 having a larger groove width. As a result, the hair 40 introduced into the blade groove 32 can be prevented from escaping therefrom. Further, the blade edges 31 of the movable blade 3 are inclined to the blade edges 21 of the blade piece 20 of the fixed blade 2 through out the entire length thereof by the acute included angle $\alpha$ so that the hair 40 can be cut effectively along the entire projecting direction Y of the blade piece 30 of the movable blade 3.

Figure 10A:
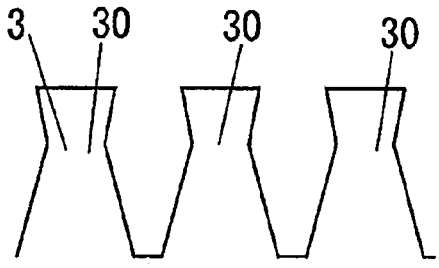
FIG. 10A is a front view.
Figure 10B:
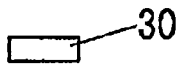
(PRIOR ART) FIG. 10B
FIG. 10B is a cross-sectional view.

Furthermore, for example, in case the blade edges 31 have no acute rake angle $\beta$ and no rake surface 37 as shown FIGS. 10A and 10B, the hair may be pulled by the movable blade 3 while cutting the hair 40. In contrast, in the present invention, the blade edges 31 of the movable blade 3 have the rake surface facing the opposite side to the fixed blade 2 inclined with respect to the sliding direction of the movable blade 3 by an acute angle $\beta$ throughout its entire length. Therefore, it is possible to prevent the hair 40 from being pulled by the blade edges 31 of the movable blade 3 throughout the entire projecting direction Y of the blade piece 30 of the movable blade 3.

While the invention has been shown and described with respect to the embodiments, it will be understood by those skilled in the art that various changes and modifications may be made without departing from the scope of the invention.

What is claimed is:

1. A hair clipper including a comb shaped fixed blade having a plurality of fixed blade pieces and a movable blade having a plurality of movable blade pieces arranged in parallel to form a blade groove between each pair of adjacent movable blade pieces, the fixed blade and the movable blade being overlapped with each other, and the movable blade being reciprocally slid with respect to the fixed blade in an arrangement direction of the movable blade pieces, wherein:

each fixed blade piece includes a leading portion protruding beyond each movable blade piece and a basal portion extending from a basal end of the fixed blade piece to beyond each movable blade piece to the leading portion of the fixed blade piece, both the leading portion and the basal portion having fixed blade edges formed at both sides thereof, each fixed blade edge being inclined to a projecting direction of the fixed blade pieces such that the distance between two adjacent fixed blade pieces becomes greater as the edge goes from a basal end of the fixed blade piece toward a leading end of the fixed blade piece, and the fixed blade edges of the leading portion are inclined to the projecting direction at a greater angle than the fixed blade edges of the basal portion;

each movable blade piece has movable blade edges formed at both sides thereof, each movable blade edge being formed with a leading rectilinear part inclined such that the distance between the adjacent movable blade pieces increases along the length of the movable blade edges from the leading end of the movable blade piece toward the basal end of the movable blade piece, and with a basal rectilinear part having one end connected to the leading rectilinear part and inclined such that the distance between the adjacent movable blade pieces decreases as the edge goes from the connected end to the basal end of the movable blade piece;

the leading rectilinear part and the basal rectilinear part of each movable blade edge are inclined with respect to the fixed blade edges by a first and a second acute included angle, respectively;

each movable blade edge has a rake surface facing an opposite side to the fixed blade, the rake surface being inclined with respect to the sliding direction of the movable blade throughout an entire length of the leading rectilinear part and the basal rectilinear part by an acute rake angle; and a width of an entrance of the blade groove is wider than a width of a part of each fixed blade piece contacting the leading ends of the movable blade pieces, so that the entrance of the blade groove is opened regardless of a position of each movable blade.

2. The hair clipper of claim 1, wherein the first and the second included angle are greater than 16° and smaller than 23°.

3. The hair clipper of claim 1, wherein a cross-sectional shape of said each movable blade piece has a trapezoidal lower portion and a rectangular upper portion, and wherein the rectangular upper portion is provided with a rounded surface at a leading upper end portion thereof.

4. The hair clipper of claim 1, wherein the first and the second included angle are greater than 11° and smaller than 30°.

5. The hair clipper of claim 1, wherein each fixed blade edge has an inclined surface facing an opposite side to the movable blade, the inclined surface being inclined with respect to the sliding direction of the movable blade throughout an entire length of each fixed blade edge by an incline angle; and wherein the incline angle of the fixed blade is greater than the acute rake angle of the movable blade.

* * * * *